US006061537A

United States Patent [19]

Nakajima et al.

[11] Patent Number: 6,061,537

[45] Date of Patent: May 9, 2000

[54] ELECTROPHOTOGRAPHIC PRINTER

[75] Inventors: Shigeki Nakajima; Atsushi Kobayashi, both of Tokyo, Japan

[73] Assignee: Oki Data Corporation, Tokyo, Japan

[21] Appl. No.: 09/209,148

[22] Filed: Dec. 10, 1998

[30] Foreign Application Priority Data

Dec. 12, 1997 [JP] Japan ..... 9-343185

[51] Int. Cl.[7] ..... G03G 15/00

[52] U.S. Cl. ..... 399/107; 399/299

[58] Field of Search ..... 399/107, 110, 399/111, 112, 179, 223, 298, 299, 123

[56] References Cited

U.S. PATENT DOCUMENTS 5,493,377 2/1996 Nishikawa et al. ..... 399/328

5,606,406 2/1997 Ikeyama et al. ..... 399/111

5,740,493 4/1998 Otaki et al. ..... 399/71

5,842,095 11/1998 Kitamura ..... 399/299

*Primary Examiner*—William Royer

*Assistant Examiner*—Greg Moldafsky

*Attorney, Agent, or Firm*—Akin, Gump, Strauss, Hauer & Feld, L.L.P.

[57] ABSTRACT

An electrophotographic recording apparatus has a plurality of image-forming sections and records a full color image. The apparatus includes a chassis and two plate-like supporting members oppositely disposed on the chassis. The two supporting members extend parallel with each other. The supporting members has means which support components of the plurality of image-forming sections between the two supporting members so that the components are placed in position relative to each other.

8 Claims, 11 Drawing Sheets

27b
27b
27b
F
6
WHEN ROTATIONAL MOMENT IS NOT EXERTED
WHEN ROTATIONAL MOMENT IS EXERTED
g
MAIN BODY 27
27
27
27
97
92
9b
9a
7
6
91
93
95
94
96

ELECTROPHOTOGRAPHIC PRINTER

BACKGROUND OF THE INVENTION

1. Field of the Invention

The present invention relates to an electrophotographic recording apparatus which records a plurality of images of different colors on a print medium, and more particularly to an electrophotographic recording apparatus which includes a plurality of image-forming sections aligned in line.

2. Description of Related Art

One such conventional apparatus is an electrophotographic recording apparatus where image-forming sections for yellow, magenta, cyan, and black images record images of the corresponding colors in sequence.

The images of the four colors are recorded one upon another on a sheet of print medium. The print medium is transported on a loop-like transport belt that runs at a predetermined constant speed so that the print medium travels at a constant speed through the image-forming sections. The print medium is attracted to the transport belt by the Coulomb force and passes between the photoconductive body and the transfer member at each image-forming section.

The respective image-forming sections are usually detachably mounted to the main body of the recording apparatus and therefore they are replaceable. If the image-forming sections are not accurately positioned relative to each other, the recorded images are out of register. In order to prevent such an out-of-registration problem, the image-forming sections have positioning means which serves to accurately position themselves.

However, even if the image-forming sections are individually positioned with a predetermined accuracy, dimensional errors among the image-forming sections are accumulated, necessitating some correction or adjustment for precise alignment. Further, using a belt for transporting the print medium requires, skew correction of the belt, means for applying electrostatic force to the belt, means for replacing the belt. The use of the belt renders the apparatus larger and more complex, increasing the manufacturing costs.

SUMMARY OF THE INVENTION

An object of the invention is to provide an electrophotographic recording apparatus where structural components of a plurality of image-forming sections are accurately positioned with respect to each other without cumulative dimensional errors.

Another object of the invention is to provide an electrophotographic recording apparatus where a recording medium is advanced without using a transport but only by the rotational forces of the photoconductive bodies and transfer member in contact with the photoconductive bodies along the transport path of the recording medium.

An electrophotographic recording apparatus for recording a color image, the apparatus having a plurality of image-forming sections. The apparatus comprises a chassis and two plate-like supporting members oppositely disposed on the chassis. The two supporting members extend parallel with each other and have means for supporting components of the plurality of image-forming sections between the two supporting members so that the components are placed in position relative to each other.

The plurality of image-forming sections include corresponding photoconductive bodies. The photoconductive bodies are positioned such that a center-to-center distance between adjacent photoconductive bodies is less than a third of a length of a minimum-size recording medium. The recording medium is transported by the rotational forces of the transfer roller and the photoconductive body.

The recording apparatus also has a fixing unit disposed downstream of the plurality of image-forming sections. The recording apparatus also includes first, second, and third drive mechanisms and a controller for controlling the drive mechanisms. The first drivemechanism drives transport belt to run. The transport belt transports the recording medium to an image-forming section disposed at an upstream end of the plurality of image-forming sections. The second drive mechanism drives the components of the plurality of image-forming sections in rotation. The third drive mechanism drives the fixing unit in rotation. The controller controls the first, second, and third drive mechanisms independently of each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the accompanying drawings.

<Overall Construction>

Figure 1:
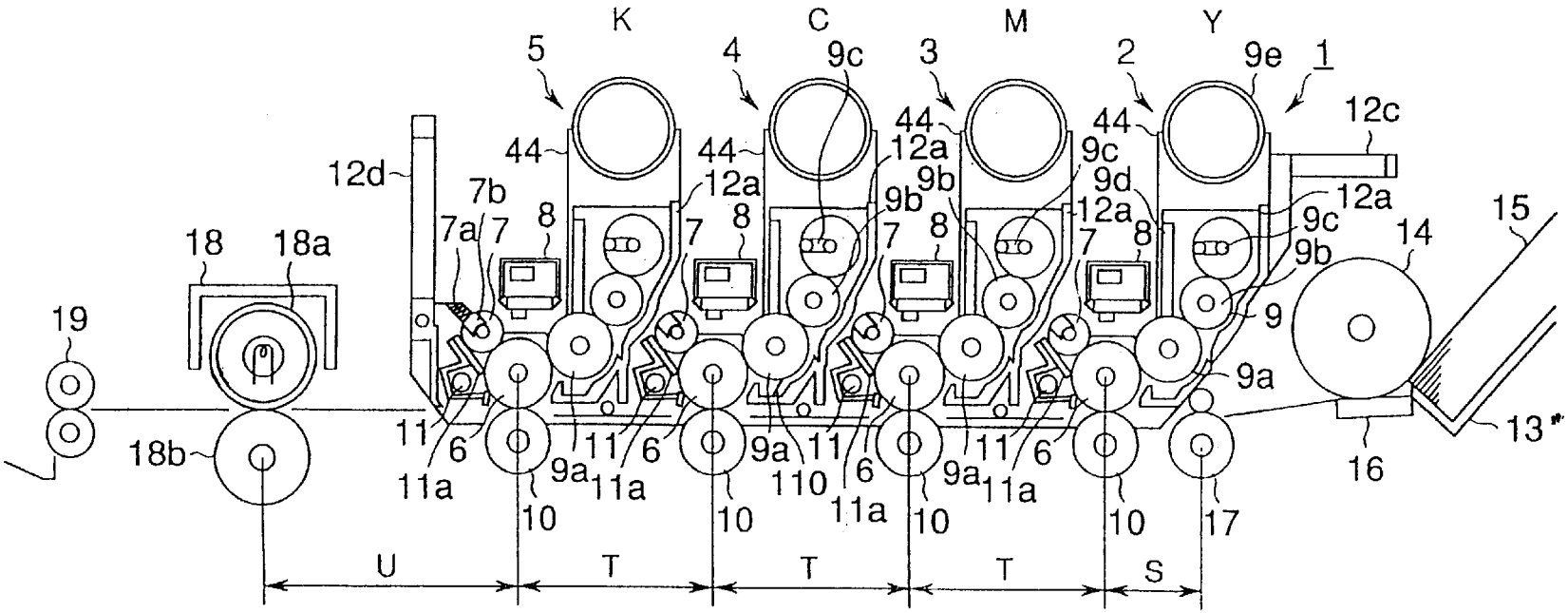
FIG. 1 illustrates an electrophotographic recording apparatus according to an embodiment of the invention.

FIG. 1 illustrates an electrophotographic recording apparatus according to an embodiment of the invention. The embodiment will be described with respect to an electrophotographic recording apparatus which records four colored toner images.

Referring to FIG. 1, an electrophotographic recording apparatus 1 includes image-forming sections 2, 3, 4, and 5 for yellow, magenta, cyan, and black images. The four image-forming sections are of the same construction and therefore the image-forming section 2 for yellow image will be described by way of example. The image-forming section 2 includes a photoconductive drum 6, charging roller 7, exposing unit 8, developing unit 9, transfer roller 10, and cleaning unit 11. The photoconductive drum 6 has a photoconductive layer applied on the surface of a hollow cylinder made of an electrical conductor such as aluminum, so that an electrostatic latent image can be formed on the layer. The photoconductive drum 6 has a later described drive gear through which the photoconductive drum 6 is driven in rotation in contact with the charging roller 7. The charging roller 7 comprises a metal shaft on which a layer of a resilient material having a predetermined electrical resistance is provided. The metal shaft of the charging roller 7 receives a predetermined high voltage, so that the charging roller 7 uniformly charges the surface of the photoconductive drum 6. The charging roller 7 is supported by bearings 7*b* and is urged by the biasing force of springs 7*a* applied to the bearings 7*b*, so that the charging roller 7 is in contact with the photoconductive drum 6 with a predetermined pressure.

The exposing unit 8 illuminates the uniformly charged surface of the photoconductive drum 6 in accordance with print data, thereby forming an electrostatic latent image on the surface of the photoconductive drum 6. The developing unit 9 includes a developing roller 9*a*, supply roller 9*b*, agitator 9*c*, developing blade 9*d*, and toner cartridge 9*e*. The toner cartridge 9*e* is detachably mounted. The developing roller 9*a* comprises a metal shaft on which a resilient material with a predetermined electrical resistance is provided. The supply roller 9*b* supplies toner from the toner cartridge 9*e* to the developing roller 9*a*. The developing blade 9*d* limits the thickness of the toner layer on the developing roller 9*a*. The agitator 9*c* provided over the supply roller 9*b* agitates the toner so that the toner is supplied evenly across the length of the developing roller 9*a* irrespective of the consumption rate of toner. The shaft of the developing roller 9*a* receives a predetermined high voltage. The developing roller 9*a* rotates in contact with or with a predetermined distance away from the photoconductive drum 6, thereby developing the electrostatic latent image on the photoconductive drum 6 with toner.

The transfer roller 10 comprises a metal shaft on which a resilient material having a predetermined electrical resistance is provided. The transfer roller 10 is rotated in contact with the photoconductive drum 6. The transfer roller 10 receives a high voltage opposite in polarity to the toner on the photoconductive drum 6, so that the toner on the photoconductive drum 6 is attracted to the recording medium by the Coulomb force developed between the transfer roller 10 and the photoconductive drum 6. The cleaning unit 11 has a scratch blade 11*a* which scratches the toner left on the surface of the photoconductive drum 6.

The image-forming sections 2, 3, 4, and 5 are for forming yellow image, magenta image, cyan image, and black image, respectively. The transfer rollers 10 are disposed immediately under the corresponding photoconductive drums 6. The photoconductive drums 6 are arranged at intervals T, T being selected to be less than a third of the length of minimum-size recording paper in the direction of travel of the recording paper. In the embodiment, the interval T is selected to be 46 mm and the recording paper is transported by the rotational forces of the photoconductive drum 6 and the transfer roller 10 at each image-forming section. Most of ordinary recording apparatuses assumes that the minimum length of the recording paper is 148 mm which is a length of a post card. Selecting the interval T of 46 mm allows the minimum-size recording paper (post card) to be held at a maximum of three locations thereof between the photoconductive drum 6 and the transfer roller 10 when the recording paper is being advanced from image-forming section 2 toward image-forming section 5. A plate-like platform is provided between adjacent photoconductive drums 6 in order to guide the recording paper horizontally from drum to drum.

In order to set the interval T less than a third of the length of the minimum-size recording paper, the diameters of the photoconductive drum 6, developing roller 9*a*, and charging roller 7 are selected to be 16 mm, 14 mm, and 9 mm, respectively, the supply roller 9*b* is located over the developing roller 9*a*, and the agitator 9*c* is disposed over the supply roller 9*b*.

The springs 7*a* are mounted on partitioning walls 12*a* of a main chassis 12 and urge the charging roller 7 against the photoconductive drum 6. Three partitioning walls 12*a* are provided between adjacent image-forming sections and one partitioning wall 12*a* is provided upstream of the image-forming section 2 with respect to the transport path of the recording paper. The partitioning walls 12*a* define outer walls of the developing units 9, support the springs 7*a* of the image forming sections, and protect the cleaning section 11. The main chassis 12 will be described later in more detail.

Disposed on the right side of the image-forming section 2 are a paper cassette 13 and a paper-feeding roller 14. The paper cassette 13 holds a stack of recording paper 15 therein. A separator pad 16 is in pressure contact with the paper-feeding roller 14 so that the recording paper 15 is fed from the paper cassette 13 sheet by sheet. Disposed on the left side of the paper-feeding roller 14 are a pair of transport rollers 17. The center-to-center distance S between the transport roller 17 and the transfer roller 10 of the image-forming section 2 is selected to be 25 mm.

A fixing unit 18 is provided on the left side of the image-forming section 5. The fixing unit 18 includes a heat roller 18*a* and a pressure roller 18*b* and fixes the toner image that has been transferred to the recording paper 15. The center-to-center distance U between the heat roller 18*a* and the transfer roller 10 of the image-forming section 5 is selected to be less than the length of minimum size recording paper 15 in the direction of travel of the recording paper 15 minus 2T. In the embodiment, the distance U is 55 mm. Disposed on the left side of the fixing unit 18 are a pair of discharge rollers 19.

<Construction of Image-Forming Sections>

Figure 2:
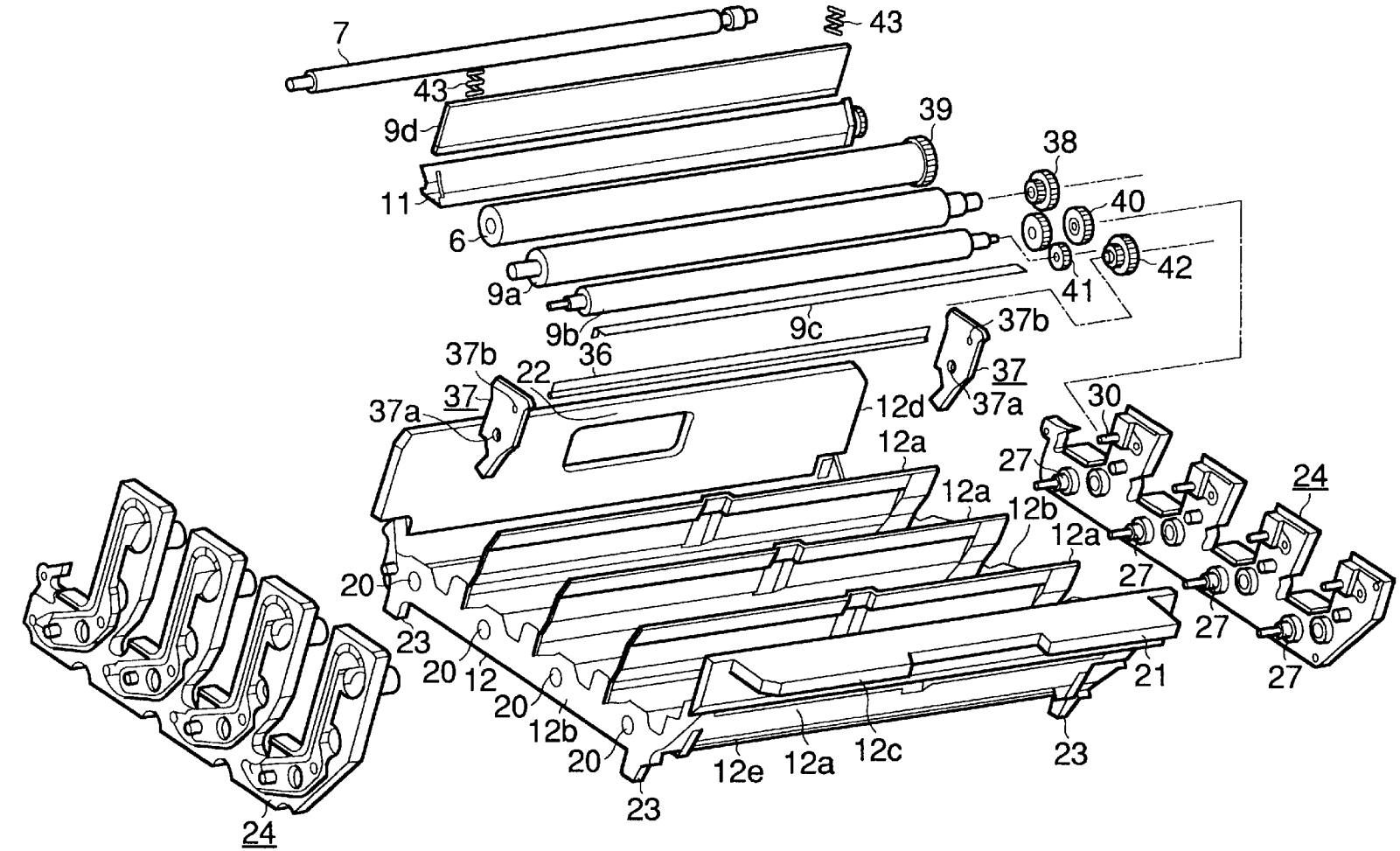
FIG. 2 is an exploded perspective view of a relevant portion of the embodiment.

FIG. 2 is an exploded perspective view of a relevant portion of the embodiment. FIG. 2 shows a main chassis 12, a pair of side plates 24, a set of sealing members 37, and a set of structural elements. The set of structural elements illustrates, by way of example, those for only one of the image-forming sections. Likewise, the set of sealing members 37 shows, by way of example, those for only one of the image-forming sections. The set of structural elements include the charging roller 7, springs 43, developing blade 9*d*, cleaning section 11, photoconductive drum 6, developing rollers 9*a*, supply roller 9*b*, agitator 9*c*, gears 38 and 40–42.

The main chassis 12 is a chassis on which the image-forming sections 2, 3, 4, and 5 are assembled. The main chassis 12 includes opposing side portions 12*b*, a front plate 12*c*, a rear plate 12*d*, a bottom plate 12*e* and the partitioning walls 12*a*. The side portions 12*b* are provided with holes 20 therein for mounting the photoconductive drums 6 of the respective image-forming section to the main chassis 12. The front plate 12*c* defines the outer wall of the developing unit 9 of the image-forming section 2, and has a hand hook 21 which facilitates the assembly of the main chassis 12 into the body of the apparatus after the respective image-forming sections 2–5 have been assembled to the main chassis 12.

The rear plate 12*d* supports the springs 7*a* of the image-forming section 5 and protects the cleaning unit 11 from the surroundings. The rear plate 12*d* has a hand hook 22 that facilitates the loading of the main chassis 12 into and the unloading of the main chassis 12 from the main body of the recording apparatus. The bottom plate 12*e* has a leg 23 at each of four corners. The legs 23 lift the entire assembly from a flat table when the assembly is placed on the flat table, so that the photoconductive drums 6 and the other structural members are not scratched by inadvertent contact with the table surface and/or surroundings.

The side plates 24 are assembled to both side portions 12*b* of the main chassis 12.

Figure 3:
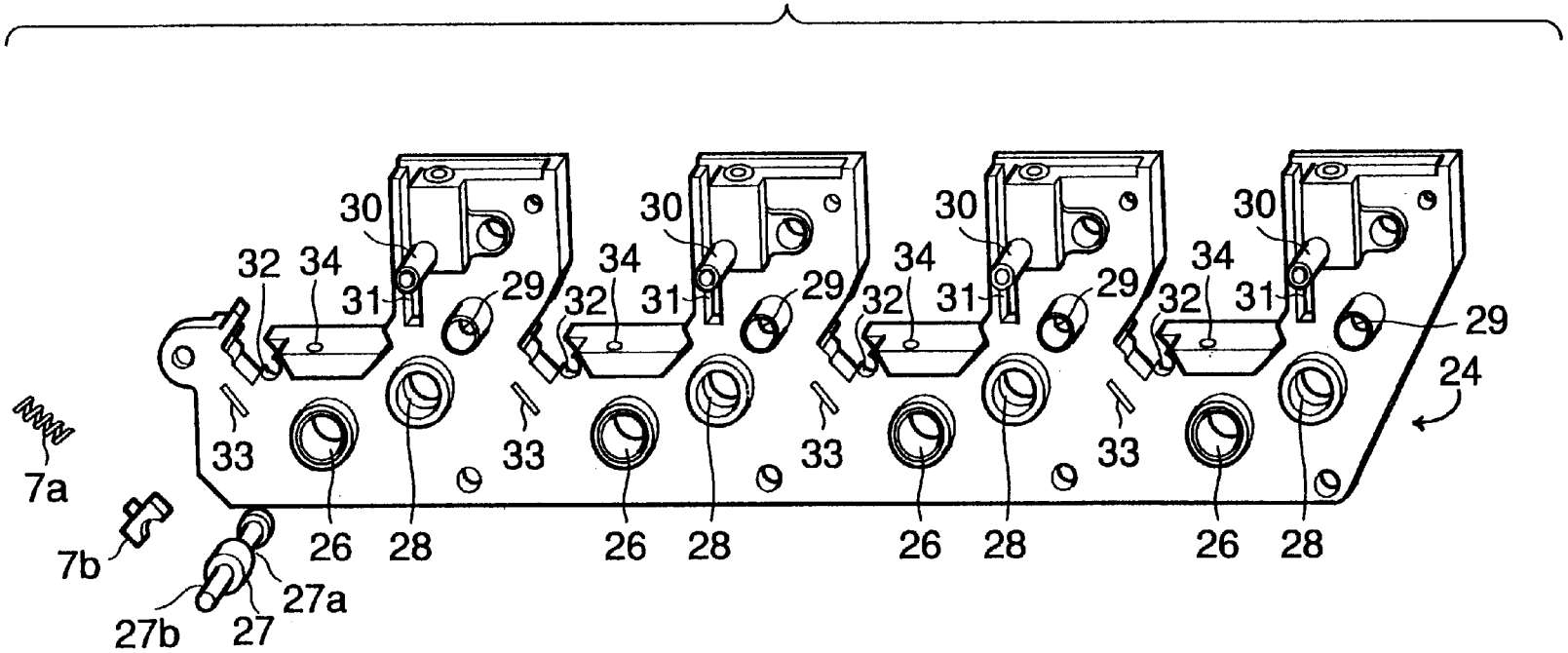
FIG. 3 is a perspective view showing the side plate.

FIG. 3 is a perspective view showing one of the side plates 24. Referring to FIGS. 2 and 3, the side plate 24 has means for positioning the photoconductive drum 6, charging roller 7, exposing unit 8, developing unit 9, supply roller 9*b*, agitator 9*c* and others. Holes 26 receive supporting members 27 to which the respective photoconductive drums 6 are fitted. The other longitudinal end of the photoconductive drums are rotatably supported by members similar to the supporting members 27 but without annular grooves 27*a*. The holes 26 are formed at predetermined accurate intervals. Each of the supporting members 27 has the annular groove 27*a* formed therein and has a free end portion 27*b* that serves as a rotational axis of the corresponding photoconductive drum 6.

Holes 28 rotatably receive the metal shafts of the respective developing rollers 9*a*. The holes 28 are accurately positioned with respect to the holes 26. Holes 29 are positioned accurately with respect to the holes 28 and rotatably receive the metal shafts of the supply rollers 9*b*. Shafts 30 are positioned accurately relative to the holes 28 and rotatably support idle gears thereon which cause the developing rollers 9*a* and supply rollers 9*b* to rotate in the same direction.

Grooves 31 receive the developing blade 9*d* and have a width substantially equal to the thickness of the developing blade 9*d*. The grooves 31 are positioned with respect to the holes 28. Each of U-shaped grooves 32 is provided with a portion that receives the bearing 7*b* and the spring 7*a* for urging the bearing 7*b*. The spring 7*a* urges the bearing 7*b* in such a way that the charging roller 7 is in contact with the photoconductive drum 6 with a predetermined pressure. The charging roller 7 is resiliently movable along the U-shaped groove 32 to and away from the photoconductive drum 6. The U-shaped grooves 32 are accurately positioned with respect to the holes 26.

Grooves 33 are accurately positioned relative to the holes 26 and each of the grooves 33 receives a longitudinal end of the cleaning unit 11 so that the cleaning unit 11 is placed in position. Holes 34 receive exposing units 8 when the exposing units 8 are mounted to the side plates 24 from above. A positioning projection provided on each longitudinal end of the exposing unit 8 drops into the hole 34 so that the exposing unit 8 is placed in position.

Each of the left and right side plates 24 is of one piece construction and has the grooves 31–33 and the holes 26, 28–29, and 34 formed therein for each of the image-forming sections. The shafts 30 are formed only on one of the side plates 24 on which drive gears are mounted. Upon having assembled, the left and right side plates 24 support the structural members of each image-forming section. In addition to the positioning functions for structural components of the image-forming sections, these side plates 24 perform other functions and therefore they are not completely symmetric in shape.

Referring again to FIG. 2, a film 36 is a longitudinally extending member and is formed of, for example, a polyester film or a thin urethane film. The film 36 is fixed at one lateral end thereof to the main chassis 12 and the lateral free end thereof lightly contacts the developing roller 9*a* from under to prevent toner from flowing in a reverse direction. The angle and pressure at which the lateral, free end of the film 36 contacts the developing roller 9*a* are such that the toner deposited on the developing roller 9*a* is not scratched off by the film 36. A sealing member 37 is made of a material such as foamed urethane and is provided at the longitudinal ends of the supply roller 9*b* and agitator 9*c* outside the print region of the recording apparatus in order to prevent toner leakage. Upon assembly, the sealing member 37 fits to the longitudinal end surface of the developing roller 9*a*, the side surface of the developing blade 9*d*, the inner surface of a later described upper lid, and the inner surface of the main chassis 12. The sealing member 37 is provided with a hole 37*a* into which the metal shaft of the supply roller 9 fits in sealing contact with the sealing member 37, and a hole 37*b* into which the shaft of the agitator 9*c* enters in sealing relation. The sealing member 37 has sufficient contact areas so that the sealing member 37 is in resilient contact with the respective members with reasonable pressure. The film 36 and sealing member 37 are provided for each image-forming section. The gear 38 rotates together with the metal shaft of the developing roller 9*a* to transmit rotation to the developing roller 9*a*. The gear 38 is in mesh with a gear 39 provided at one longitudinal end of the photoconductive drum 6, so that the rotation of the gear 39 is transmitted to the gear 38. An idle gear 40 is mounted on the shaft 30 as mentioned previously and is in mesh with the gear 38 of the developing roller 9*a* and the gear 41 of the supply roller 9*b*. The gear 41 rotates together with the metal shaft of the supply roller 9*b* and is in mesh with the gear 42 that drives the agitator 9*c* in rotation. These gears 41 and 42 are located on the inner surface of the sealing member 37 and above the side portion 12*b* of the main chassis 12.

The spring 43 is mounted at each longitudinal end portion of the developing blade 9*d*, one end of the spring 43 contacting with the upper surface of the developing blade 9*d* and the other end abutting the inner surface 44*a* of the upper lid 44. The spring 43 urges the developing blade 9*d* against the developing roller 9*a*.

Figure 4:
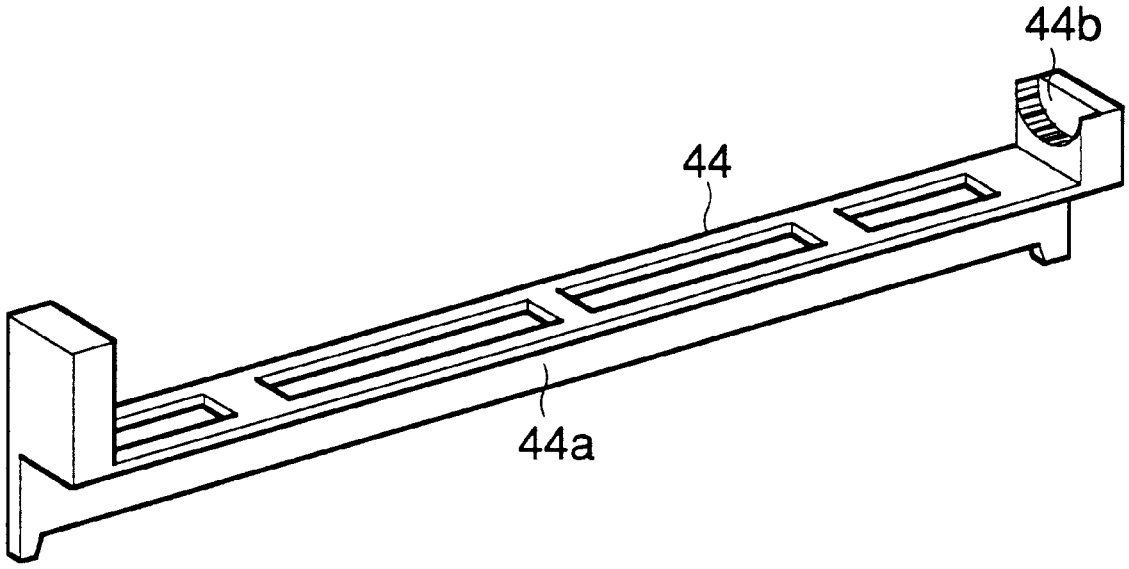
FIG. 4 is a perspective view illustrating the upper lid.

FIG. 4 is a perspective view illustrating the upper lid 44.

The inner surface 44*a* of the upper lid 44 defines an inner wall of the developing unit 9 and the upper longitudinal ends 44*b* detachably receives the toner cartridge 9*e*. The inner surface 44*a* of the upper lid 44 has a sealing member, not shown, which extends in a longitudinal direction of the upper lid 44. The sealing member is in contact with the upper surface of the developing blade 9*d* and the partitioning wall 12*a* of the main chassis 12, thereby preventing the toner from leaking.

<Driving Mechanism>

Figure 5:
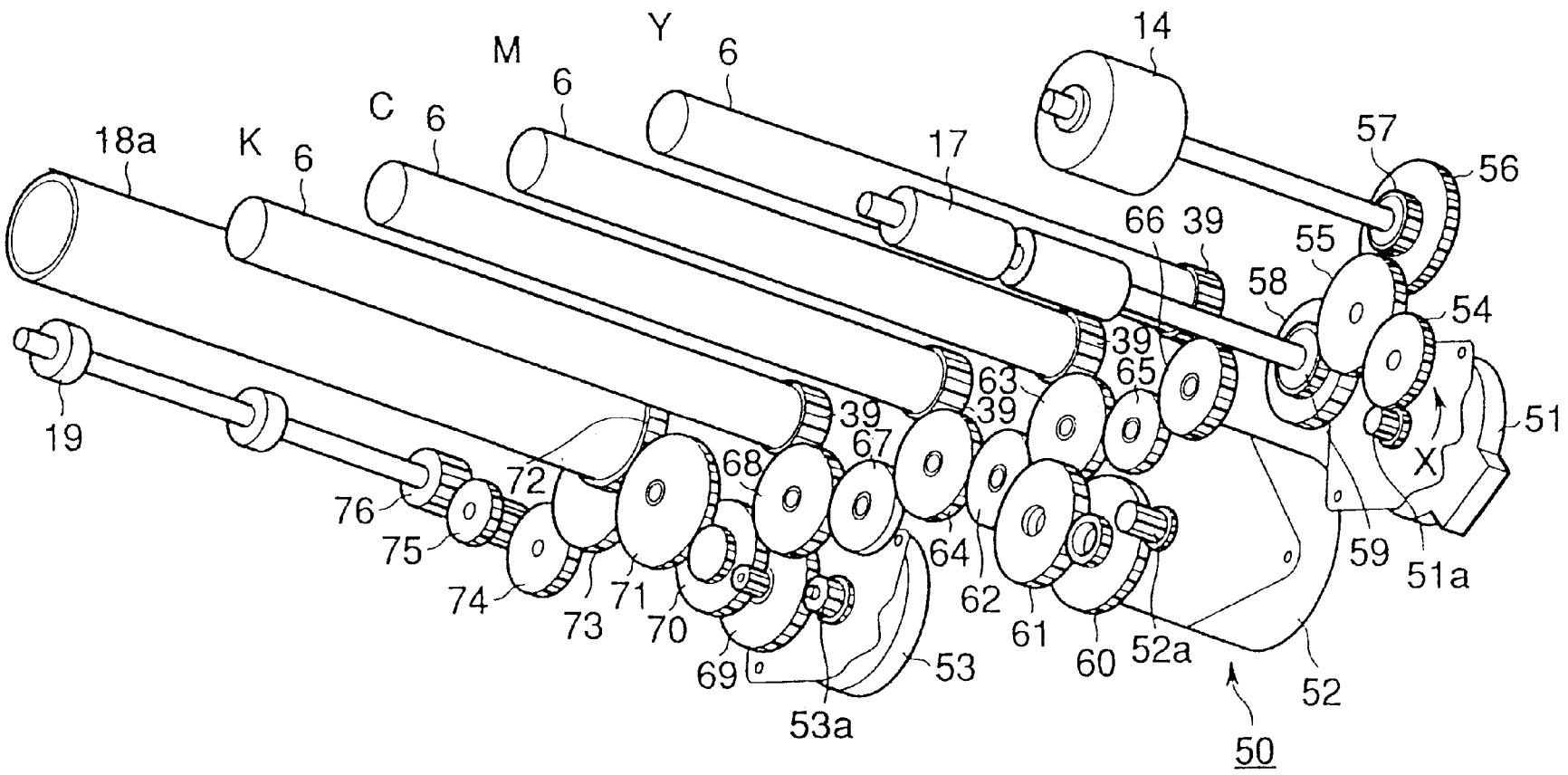
FIG. 5 is a perspective view illustrating the driving mechanism of the embodiment.

FIG. 5 is a perspective view illustrating the driving mechanism of the embodiment.

Referring to FIG. 5, the driving mechanism 50 includes three motors 51, 52, and 53. The motor 51 is a motor that drives the paper-feeding roller 14 and the transport roller 17 in rotation, and the motor gear 51*a* of the motor 51 is in mesh with a large gear of the reduction double gear 54. The small gear, not shown, of the reduction double gear 54 is in mesh with a large gear of a reduction double gear 55. The small gear, not shown, of the reduction double gear 55 is in mesh with a large gear of a reduction double gear 56. The gear 56 incorporates a built-in one way clutch 57 and drives the paper-feeding roller 14 in rotation. The drive shaft of the paper-feeding roller 14 extends into the one way clutch 57. When gear 56 rotates in such a direction as to lock the one way clutch 57, the paper-feeding roller 14 is rotated to advance the recording paper 15. When the gear 56 rotates in a reverse direction, the one way clutch 57 rotates free on the drive shaft of the paper-feeding roller 14 so that the paper-feeding roller 14 is not rotated. In other words, the motor 51 rotates in one direction to drive the paper-feeding roller 14 in rotation, and in the other direction to drive the transport roller in rotation.

A gear 58 is for driving the transport roller 17 and is in mesh with a small gear of the reduction double gear 55. The gear 58 incorporates a built-in one way clutch 59. The one way clutch 59 receives the drive shaft of the transport roller 17 therein. When the gear 58 rotates in such a direction as to lock the one way clutch 59, the transport roller 17 rotates to transport the recording paper forwardly. When the gear 58 rotates in a reverse direction, the one way clutch 59 rotates free on the drive shaft of the transport roller 17.

The motor 52 is a motor for driving the photoconductive drums 6 in rotation. A motor gear 52*a* of the motor 52 is in mesh with a large gear of a reduction double gear 60 and a small gear of the reduction double gear 60 is in mesh with a large gear of another reduction double gear 61. The reduction double gear 61 has a small gear in mesh with a large gear of a reduction gear 62. The reduction double gear 62 has a small gear in mesh with two idle gears 63 and 64. The idle gear 63 is in mesh with the gear 39 of the image-forming section 3 for magenta while the idle gear 64 is in mesh with the gear 39 of the image-forming section 4 for cyan. The rotation of the idle gear 63 is transmitted through two idle gears 65 and 66 to the gear 39 of the photoconductive drum 6 for yellow. The rotation of the idle gear 64 is transmitted through two idle gears 67 and 68 to the gear 39 of the photoconductive drum 6 for black. The motor 53 is a motor that drives the fixing unit 18 and the pair of discharge rollers 19. The motor 53 has a motor gear 53*a*, which is in mesh with a large gear of a reduction double gear 69. A small gear of the reduction double gear 69 is in mesh with a large gear of a reduction double gear 70. A small gear of the reduction double gear 70 is in mesh with an idle gear 71 which in turn is in mesh with a gear 72 mounted on one end of the heat roller 18*a*. The rotation of the gear 72 is transmitted through the idle gears 73, 74, and 75 to a gear 76 that drives the discharge roller 19 in rotation.

As described above, the paper-feeding roller 14 and transport roller 17, photoconductive drums 6, and fixing unit 18 are driven by corresponding drive sources independent of each other. The rotational speed of the transport rollers 17 and the rotational speed of the heat roller 18*a* may be adjusted independently. Hence the speed with which the paper 15 is transported by these two rollers 17 and 18*a* can be adjusted independently with respect to the rotational speed of the photoconductive drum 6. For example, variations in the outer diameters of the transport roller 17 may cause variations in the transport speed of the recording paper transported by the transport roller 17. The independent adjustment of the rotational speed of transport rollers 17 can accommodate such dimensional variations, thereby allowing adjustment of speed of the transport roller 17 in accordance with the rotational speed of the photoconductive drum 6.

<Fixing of Supporting-Members>

Figure 6A:
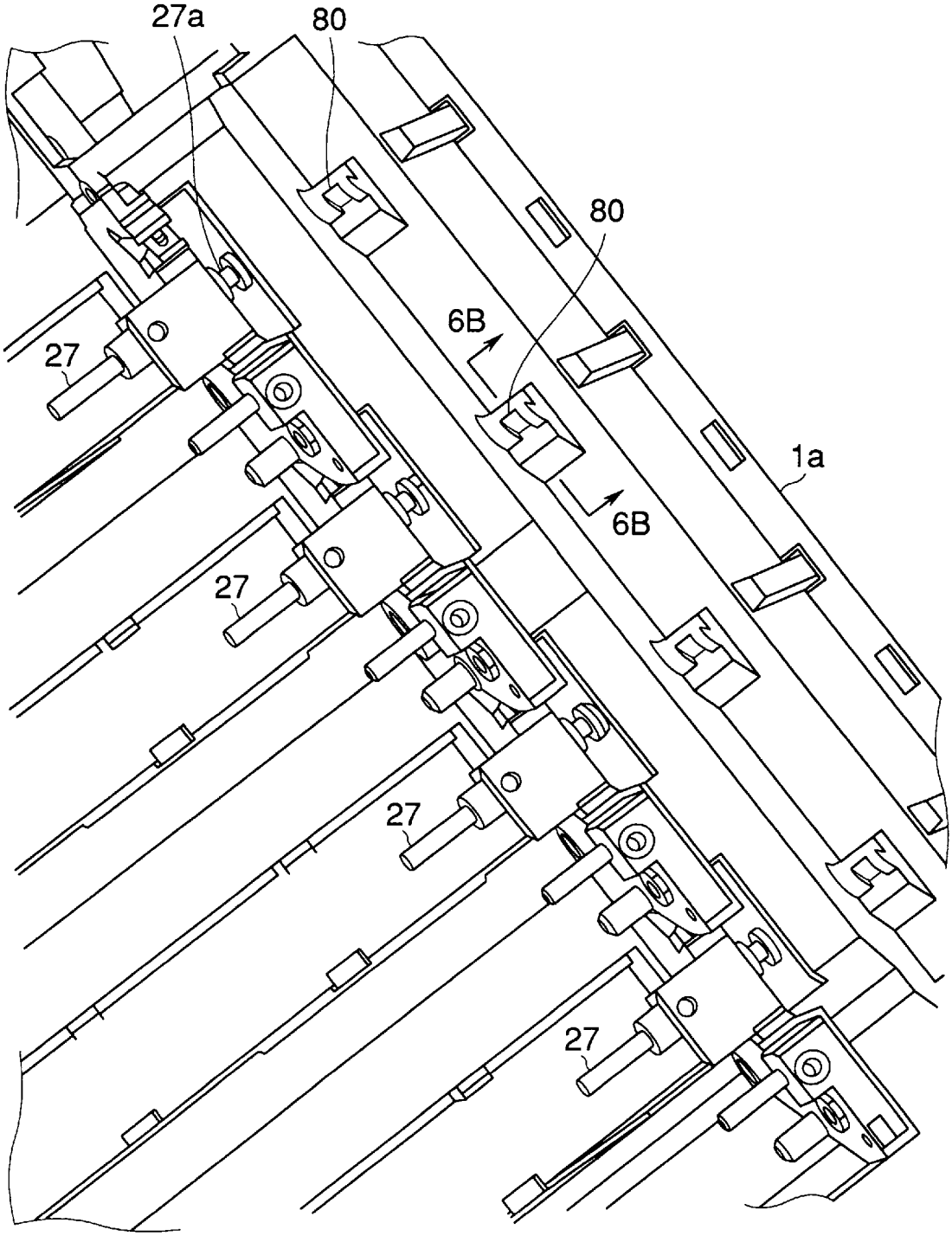
FIG. 6A is a partial perspective view of an image-forming section when it is about to be assembled on the main chassis onto the main body of the recording apparatus.

FIG. 6A is an entire assembly of the image-forming sections 2–5 just before it is assembled into the main body of the recording apparatus. Only relevant structural elements are shown for simplicity.

Figure 6C:
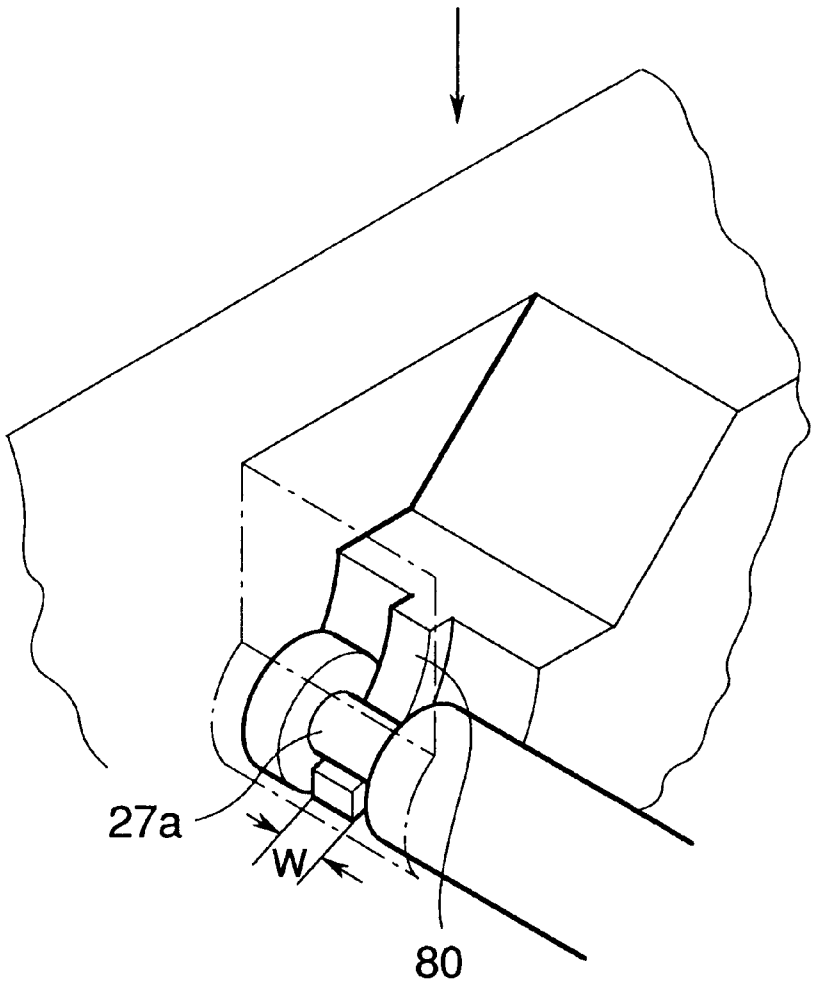
FIG. 6C is a fragmentary perspective view of an annular groove 27*a* and a projection 80.
Figure 6B:
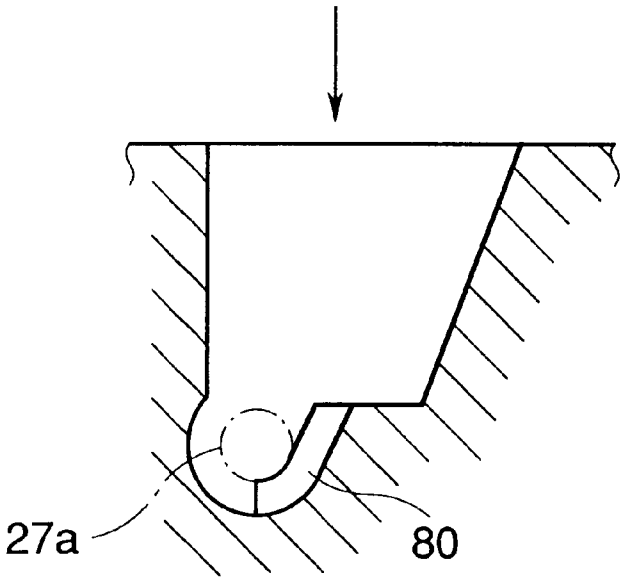
FIG. 6B is a cross-sectional view of an annular groove 27*a* and a projection 80.

FIG. 6B is a cross-sectional view of an annular groove 27*a* and a projection 80.

FIG. 6C is a fragmentary perspective view of an annular groove 27*a* and a projection 80.

Referring to FIGS. 6A–6C, the supporting members 27 are pressed into the side plate 24. The supporting member 27 has the annular groove 27*a* formed therein into which a projection 80 on the main body of the recording apparatus enters when the main chassis 12 is assembled into the apparatus. The projection 80 has a width W formed with an accuracy that provides transition fit between the groove 27 and the projection 80. The projections 80 are provided only on one side of the apparatus frame 1*a*.

Figures 7A, 7B, 7C:
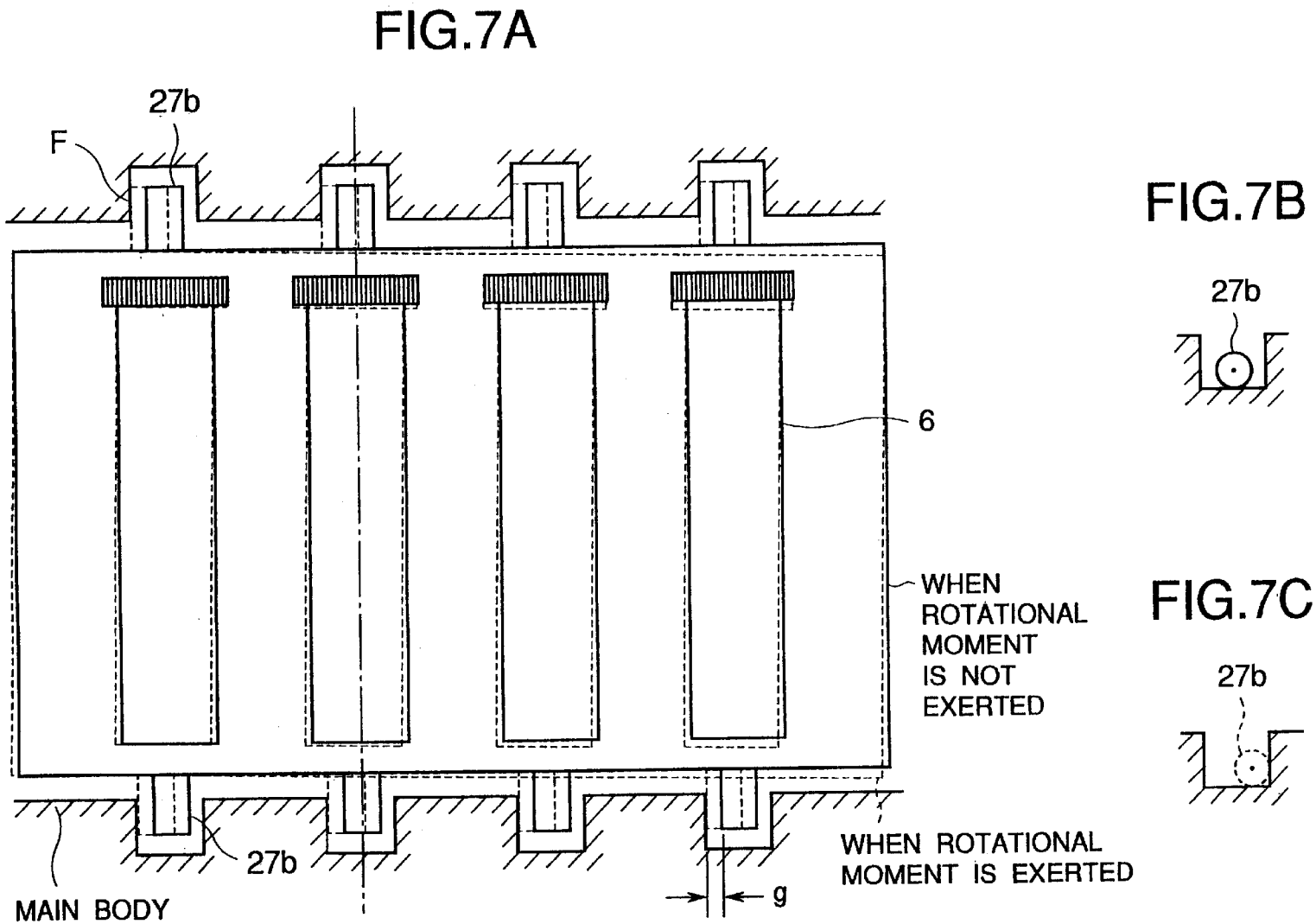
FIGS. 7A–7C illustrate the image-forming sections when they are rotated by driving force applied to the photoconductive drums.

Referring to FIG. 7A, when the drive forces are transmitted to the image-forming sections, the entire structure of image forming sections on the main chassis 12 receives a rotational moment resulting from the drive force applied and a distance between a supported portion F of the entire structure and a point on which the drive force is exerted. The rotational moment could cause the free end portion 27*b* of the supporting member 27 to move from the position shown in FIG. 7B to the position shown in FIG. 7C and the entire structure to rotate about the point F and continued application of the driving force could result in a distortion of the entire assembly of the image-forming sections. If parallelism between the main body and the opposing side plates 24 that support the image-forming sections is properly maintained, the distortion of the image-forming sections is suppressed by the walls of the plates 24, even if the drive force is exerted upon the image-forming sections. However, if the parallelism between the main body and the side plates 24 is impaired, the drive force may cause the entire structure to become twisted relative to the main body of the recording apparatus. FIG. 7A is an illustrative diagram of the image-forming sections when the entire structure is rotated.

In FIG. 7A, the entire assembly on which the photoconductive drums 6 are supported is rotated by the drive force from the solid line positions to the dotted line positions due to the fact that a distance g between one side of the main body and the other side exists. The distance g might be an assembly error during the manufacture. If the photoconductive drum 6 is driven in rotation when the entire assembly can be rotated as shown in FIG. 7A, the photoconductive drum 6 is twisted after the entire assembly of the image-forming sections has been rotated to the dotted line position in a direction shown by arrow A. Such a dimensional error as the distance g can occur due to variations in assembly accuracy and manufacturing variations of individual components. Therefore, it is critical to minimize dimensional errors in order to maintain print quality. In order to prevent such a distortion, the apparatus is provided with the grooves 27*a* and projections 80 as shown in FIG. 6.

The projection 80 and groove 27*a* are provided on the driven side (near the gear) of the photoconductive drum 6 so that a rotational moment exerted on the image-forming section is minimized. The photoconductive drum 6 supported on the portions 27*b* of the supporting members 27 usually rotates only in a fixed direction. Accordingly, the supporting member 27 tends to deviate from its intended position in a fixed direction. Thus, the projection 80 is disposed diagonally under the groove 27*a*, i.e., at a location toward which the groove 27*a* tends to deviate from where it should be. The projection 80 serves to prevent the supporting members 27 from being displaced. Providing the projection 80 on a more rigid frame allows the supporting member 27 to be positioned more reliably.

Figure 8:
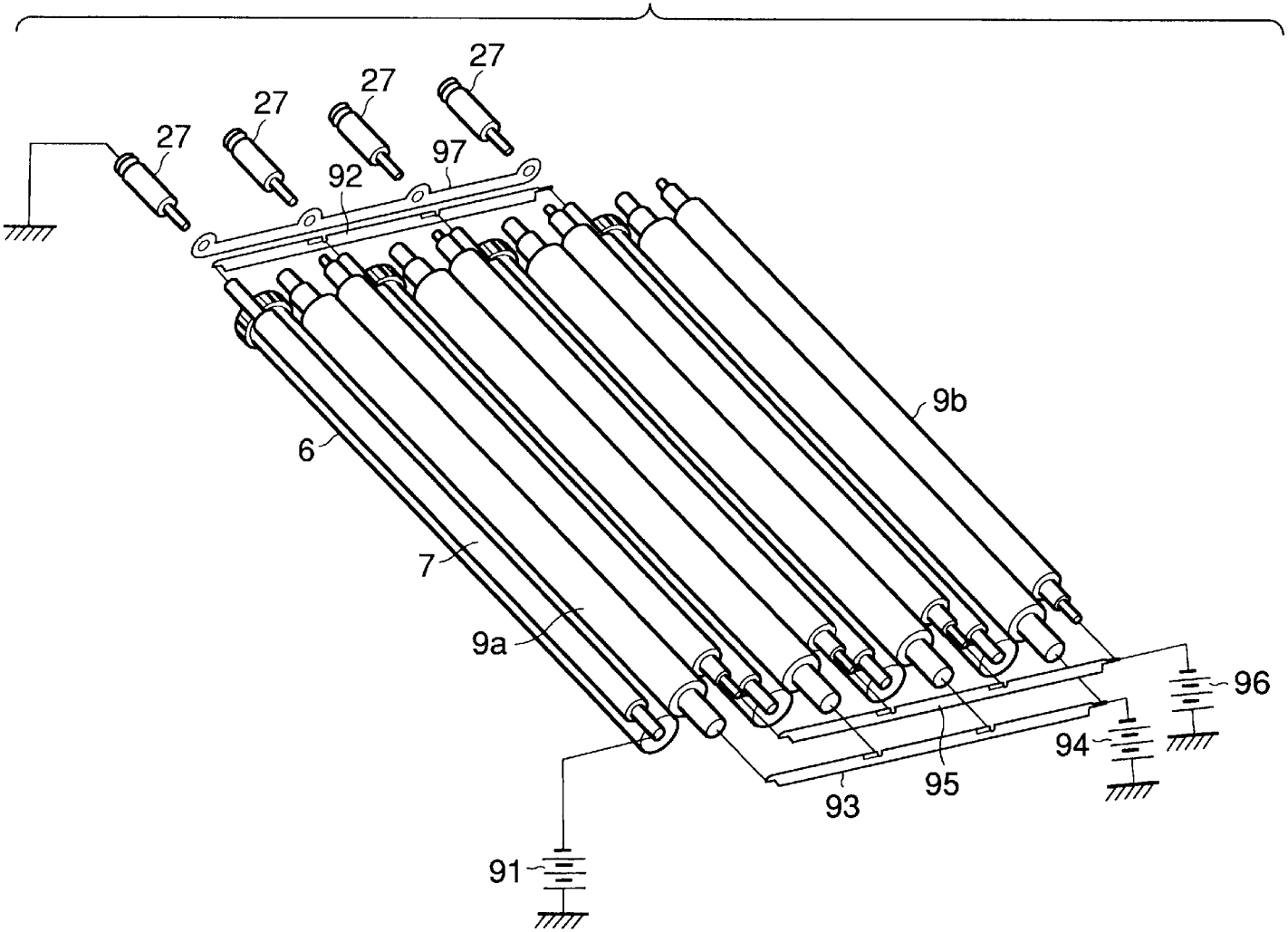
FIG. 8 illustrates the electrical connection between the structural elements of the respective image-forming sections.

FIG. 8 illustrates the electrical connection between the structural elements of the respective image-forming sections 2–5. Referring to FIG. 8, a power supply 91 is connected to one longitudinal end of the metal shaft of the leftmost charging roller 7. The other longitudinal end of the charging roller 7 is in contact with a resilient electrical conductor 92. The conductor 92 is in contact with the metal shafts of all the charging rollers 7. The power supply 91 applies a negative predetermined high voltage to the charging roller 7. A resilient electrical conductor 93 is in contact with longitudinal ends of the respective developing rollers 9*a*. The electrical conductor 93 is connected to a power supply 94. Likewise, a resilient electrical conductor 95 is in contact with longitudinal ends of the respective supply rollers 9*b*. The conductor 95 is connected to a power supply 96. The supporting members 27 that support the corresponding photoconductive drums 6 are electrically connected to each other through an electrical conductor 97. The leftmost supporting member 27 is connected to the chassis (ground) of the main body of the apparatus.

As described above, two electrical conductors are disposed on each side of the image-forming sections so that the similar structural elements are easily connected together, reducing the number of points that should be in contact with the main body side of the apparatus. This structure reduces complex wiring work of a plurality of conductors, providing a simple electrical configuration.

Figure 9:
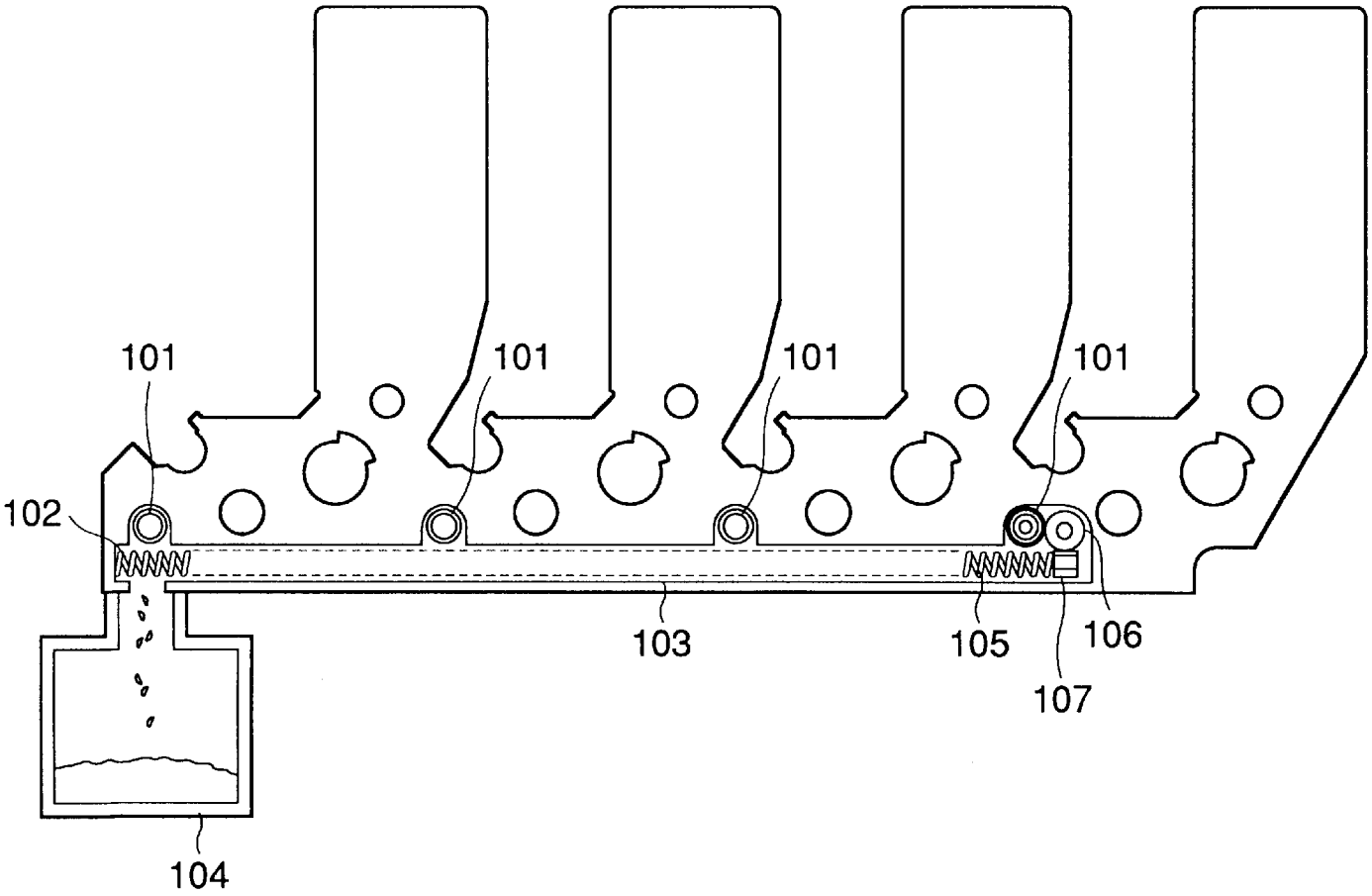
FIG. 9 illustrates a path for recovering residual toner.

FIG. 9 illustrates a path for recovering residual toner. Referring to FIG. 9, recovery shafts 101 are provided at the cleaning unit 11 of the respective image-forming sections. When rotated, the recovery shaft 101 serves to transport the toner, which is recovered by the cleaning unit 11, along the cleaning unit 11 from one end of the recovery shaft 101 to the other. The recovery shaft 101 is a rod-like member having a spiral guide formed thereon. Alternatively, the recovery shaft 101 may take the form of a coil. A recovery shaft 102 is assembled in a recovery path 103 formed in the side plate 24. The recovery shafts 101 transport the residual toner to the recovery path 103. The toner arriving at the recovery path 103 is then transported by means of the recovery shaft 102 to the recovery tank 104. The recovery tank 104 is detachably mounted to the underside of the recovery path 103.

The respective recovery shafts 101 are rotated by a common drive source. The recovery shaft 101 for yellow image-forming section 2 has a gear 105 mounted to one end of the recovery shaft 101. The gear 105 is in mesh with a gear 107 via a gear 106, the gear 107 being provided at the longitudinal end of the recovery shaft 102.

As described above, the recovery path 103 is provided in the side plate 24 so as to collect the recovered toner into a single recovery tank 104. This construction is advantageous in that when the image-forming sections are taken out of the recording apparatus for maintenance purpose, toner leakage is minimized.

<Assembling Image-Forming Sections>

The assembling operation of the embodiment will now be described.

First, the assembly of the respective image-forming sections into an integral structure will be described. Referring to FIG. 2, a film 110 (FIG. 1) is mounted to the main chassis 12 for preventing the reverse flow of the toner. The supply roller 9*b* and agitator 9*c* are inserted into the holes 37*a* and 37*b* formed in the sealing member 37, respectively, and the gears 41 and 42 mounted to the supply roller 9*b* and agitator 9*c*, respectively, are also placed in position on the main chassis 12. Then, the cleaning unit 11 is placed in position. Thereafter, the photoconductive drum 6, developing roller 9*a*, and their associated gears 38 and 40 are placed in position. In the aforementioned manner, the components for each respective image-forming section are placed in position.

Then, the two opposing side plates 24 having supporting members 27 pressed thereinto are assembled in such a way that the components for the respective image-forming sections are supported between the opposing side plates 24. The side plates 24 are positioned relative to the main chassis 12 when one ends of the shafts 27*b* for the photoconductive drums 6 projecting from the side plate 24 are inserted into the holes 20 formed in the side portion 12*b* of the main chassis 12 and other ends of the shafts 27*b* for the photoconductive drums 6 receive the free ends of the supporting members 27. The other components are positioned with reference to the side plates 24.

After the side plates 24 have been assembled to the main chassis 12, the charging rollers 7 are mounted to the side plates 24 with the metal shafts of the charging rollers 7 received in the U-shaped grooves 32 (FIG. 3). The springs 7*a* and bearings 7*b* are also assembled together. Then, the developing blades 9*d* are assembled to the grooves 31 formed in the side plates 24, and the upper lid 44 is then assembled together with the springs 43 and sealing member 37. The aforementioned assembly operation is carried out for each image-forming section.

As described above, the respective image-forming sections are assembled on an integrally continuous main chassis 12 and are supported only by two opposed side plates 24. This construction minimizes accumulation of dimensional errors among the components of the respective image-forming sections, preventing the dimensional errors among the structural components from contributing to misregistration of colored images. The main chassis 12 is made in one-piece construction and the partitioning walls 12*a* separate the adjacent image-forming sections from each other. One side of one of the partitioning walls 12*a* serves as an inner wall of the developing unit 9 and the other side serves as a cover for the cleaning unit 11 and charging unit. The construction greatly saves the number of structural components, thereby improving assembly efficiency as well as lending itself to miniaturizing the apparatus.

When replacing the image-forming sections, the whole structure of image-forming sections may be removed simultaneously from the main body of the recording apparatus. This provides good maintainability. The construction eliminates individual management of image-forming sections for different colors.

<Recording Operation>

The recording operation will now be described.

Referring to FIGS. 1 and 5, upon receiving print data, the motor 53 is energized to drive the heat roller 18*a* of the fixing unit 18 and the pair of discharge rollers 19 into rotation, and a heater 18*c* is energized so that the heat roller 18*a* is warmed up to a predetermined temperature. Then, the motor 52 is energized to drive the photoconductive drums 6 and the components of the respective image-forming sections into rotation, and the surface potentials of the photoconductive drums 6 are stabilized. After the fixing temperature and the surface potentials of the photoconductive drums have reached their steady states, the motor 51 is energized.

When the motor 51 rotates in the direction shown by arrow X shown in FIG. 5, the paper-feeding roller 14 rotates in such a direction as to advance the recording paper 15. At this time, the one way clutch 59 does not allow the transport rollers 17. The rotation of the paper-feeding roller 14 feeds the recording paper 15 from the paper cassette 13. Then, the leading end of the recording paper 15 abuts the contact point where the transport rollers 17 are in contact with each other so that the recording paper 15 has a slack. After the recording paper 15 has a slack, the motor 51 is rotated in a reverse direction. Thus, the transport roller 17 rotates in such a direction as to advance the recording paper 15. At this time, the one way clutch 57 does not drive the paper-feeding roller 14 in rotation. However, the paper-feeding roller 14 continues to rotate free till the recording paper 15 leaves the paper-feeding roller 14, thus preventing the following page of the recording paper 15 from being advanced together with the preceding page.

The recording paper 15 is transported to the contact area between the photoconductive drum 6 and the transfer roller 10 of the first image-forming section 2 (for yellow image).

The exposing units 8 of the respective image-forming sections are driven in timed relation with the advancement of the recording paper 15, so that electrostatic latent images are formed at proper timings on the surfaces of the respective photoconductive drums 6. The electrostatic latent images are developed with the toner into visible images, i.e., toner images. The toner images are then transferred to the recording paper 15 by the transfer rollers 10. The toner images of the respective colors are sequentially transferred in register into a full-color toner image. The recording paper 15 is then transported to the fixing unit 8 where the full-color toner image is fused by the heat roller 18a and the recording paper 15 is then discharged by the pair of discharge rollers 19.

In the above-described recording operation, the recording paper 15, even a minimum size paper, is held at three locations thereof while the recording paper 15 is being transported after the recording paper 15 has left the transfer rollers 17. In other words, the recording paper 15 is sandwiched between the photoconductive drums and the transfer rollers of three image-forming sections.

Thus, the recording paper 15 can be reliably transported to the fixing unit 18, being prevented from misregistration of colored images as well as being free from a skew problem.

Factors that account for misregistration of the respective colored images include the tolerance of outer diameters of the photoconductive drums 6, eccentricity of the photoconductive drums 6, center-to-center distances between adjacent photoconductive drums 6, and the tolerance of fitting errors of the respective shafts. Of which, the tolerance of the outer diameters of the photoconductive drums 6, and the center-to-center distances between adjacent photoconductive drums can be closely controlled within small error ranges by carrying out the present invention which yields small overall size of the recording apparatus.

The pair of transport rollers 17, photoconductive drums 6, and the fixing unit 18 are driven in rotation by separate motors 51, 52, and 53, respectively. Driving these rotating mechanisms by these separate motors allows the speeds of the rotating mechanisms to be adjusted, independently of each other, with respect to the rotation of the photoconductive drum.

Further, the use of a small diameter photoconductive drum 6 allows variation of its outer diameter to be minimized, so that the rotations of rotating mechanisms may be controlled with respect to the rotation of the photoconductive drum 6.

Figure 10:
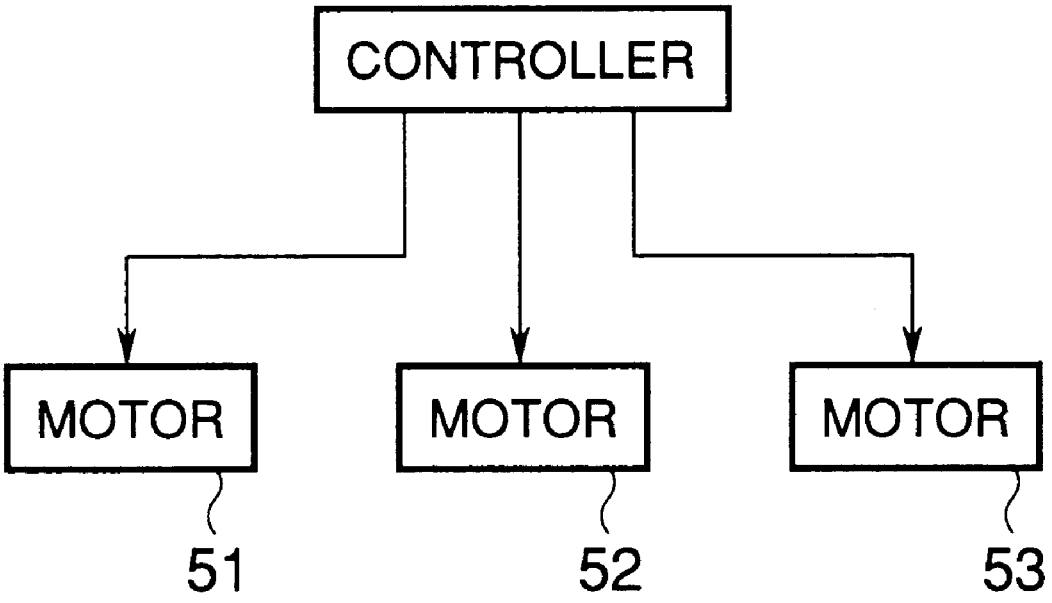
FIG. 10 illustrates a controller that controls the motors 51–53.

Factors that account for changes in the transport speed of the recording paper 15 include variations of the outer diameters of the transport rollers 17 and the outer diameters of the heat roller 18*a* of the fixing unit 18. Driving the transport rollers 17 and heat roller 18*a* by the separate motors 51 and 53, respectively, as shown in FIG. 10 allows independent adjustment of the transport speed of the transport rollers and heat rollers 18*a* with respect to the transport speed of the photoconductive drums 6.

Referring to FIG. 8, the power supply 91 applies a high voltage to one end of the metal shaft of one of the charging rollers 7 and is further applied to the other charging rollers 7 through the conductor 92 in contact with the other end of the metal shaft. The power supply 94 applies a voltage to the conductor 93 through which all the developing rollers 9*a* receive the voltage. The power supply 96 applies a voltage to the conductor 95 through which all the supply rollers 9*b* receive the voltage. The photoconductive drums 6 are connected together by the conductor 97 and therefore connecting one of the supporting members 27 to the ground allows grounding of all the photoconductive drums 6.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic recording apparatus for recording a color image, the apparatus having a plurality of image-forming sections, the apparatus comprising:

a chassis;

two plate like supporting members oppositely disposed and mounted on said chassis, said two plate-like supporting members extending parallel with each other, and having means which support components of the plurality of image-forming sections between the two plate-like supporting members ; and a positioning member assembled to at least one of said two plate-like supporting members and fitting to said chassis;

wherein when said two plate-like supporting members have been assembled to said chassis, the components are placed in position relative to each other.

2. The electrophotographic apparatus according to claim 1, wherein the plurality of image-forming sections include corresponding photoconductive bodies;

wherein said plate-like supporting members are positioned within said chassis upon assembling the photoconductive bodies between said plate-like supporting members.

3. The electrophotographic recording apparatus according to claim 1, wherein each of the image-forming sections further includes a transfer roller and a photoconductive body in pressure contact with the transfer roller, so that a print medium is pulled in between the transfer roller and the photoconductive body and transported by rotational forces of the transfer roller and the photoconductive body.

4. The electrophotographic apparatus according to claim 1 wherein the plurality of image-forming sections are aligned in a direction in which a recording medium travels, the apparatus further comprising:

a fixing unit disposed downstream of the plurality of image-forming sections in the direction in which the recording medium travels;

a first drive mechanism, driving transport means which transports the recording medium to an image-forming section disposed at an upstream end of the plurality of image forming sections;

a second drive mechanism, driving components of the plurality of image-forming sections in rotation;

a third drive mechanism, driving said fixing unit in rotation; and a controller, controlling said first, second, and third drive mechanism independently of each other.

5. The electrophotographic recording apparatus according to claim 1, further comprising:

a frame on which said chassis is assembled; and a plurality of projections formed on the frame;

wherein said positioning member is a generally rod-shaped member having longitudinally opposing first and second end portions, the first end portion fitting into the chassis and the second end portion extending outwardly from a corresponding one of said two plate-like supporting members, said second end portion having an annular groove that fits over a corresponding one of the projections when said chassis is assembled to the frame.

6. The electrophotographic recording apparatus according to claim 1, further comprising a plurality of electrodes each of which is in electrical contact with corresponding components that perform a same function so that electric power is commonly distributed to the components.

7. The electrophotographic recording apparatus according to claim 1, further comprising a plurality of first toner recovery members each of which is provided at a corresponding one of the plurality of image-forming sections, and a second toner recovery member provided at one end of the first recovery members;

wherein each of the first toner recovery members delivers residual toner from a corresponding one of the one of the plurality of image-forming sections to the second toner recovery member and the second toner recovery member delivers the residual toner to a toner recovery tank.

8. An electrophotographic recording apparatus for recording a color image, the apparatus having a plurality of image-forming sections, the apparatus comprising:

a chassis; and two plate like supporting members oppositely disposed on said chassis, said supporting members extending parallel with each other and having means which support components of the plurality of image-forming sections between the two plate-like supporting members, so that the components are placed in position relative to each other, each image forming section including a transfer roller and photoconductive body in pressure contact with the transfer roller so that a print medium is pulled between the transfer roller and the photoconductive body and transported by rotational forces of the transfer roller and photoconductive body, corresponding photoconductive bodies being positioned such that a center-to-center distance between adjacent photoconductive bodies is less than a third of a length of a medium-size recording medium.

* * * * *